US006944519B2

(12) United States Patent
Suzuki et al.

(10) Patent No.: US 6,944,519 B2
(45) Date of Patent: Sep. 13, 2005

(54) EMBROIDERY DATA PRODUCING DEVICE AND EMBROIDERY DATA PRODUCING PROGRAM STORED IN A COMPUTER READABLE MEDIUM

(75) Inventors: Mikitoshi Suzuki, Nagoya (JP); Shoichi Taguchi, Nagoya (JP); Masahiro Mizuno, Nagoya (JP); Yukiyoshi Muto, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/015,470

(22) Filed: Dec. 20, 2004

(65) Prior Publication Data

US 2005/0171628 A1 Aug. 4, 2005

(30) Foreign Application Priority Data

Feb. 3, 2004 (JP) ..... 2004-026653

(51) Int. Cl.[7] ..... D05C 5/02
(52) U.S. Cl. ..... 700/138; 112/102.5
(58) Field of Search ..... 700/138, 136, 700/137; 112/102.5, 470.06, 475.19

(56) References Cited

U.S. PATENT DOCUMENTS

| | | | | |
|---|---|---|---|---|
| 5,299,514 | A | 4/1994 | Hayakawa et al. | |
| 6,158,364 | A * | 12/2000 | Orii et al. | 112/102.5 |
| 6,587,745 | B1 * | 7/2003 | Polden et al. | 700/138 |

FOREIGN PATENT DOCUMENTS

| | | |
|---|---|---|
| JP | A 3-90 | 1/1991 |
| JP | A 5-76674 | 3/1993 |
| JP | A 7-255969 | 10/1995 |
| JP | A 7-258955 | 10/1995 |
| JP | A 2002-119780 | 4/2002 |

* cited by examiner

*Primary Examiner*—Peter Nerbun
(74) *Attorney, Agent, or Firm*—Oliff & Berridge, PLC

(57) ABSTRACT

An embroidery data producing device reads an image composed of a plurality of areas to produce embroidery data including sewing data for filling each area with stitches and underlying stitch sewing data for carrying out underlying stitch sewing for each of the areas. The embroidery data producing device includes a synthesized outline data producing unit which produces data of a synthesized outline defining an outline of a synthesized area formed by synthesizing a part or all of a plurality of the areas and an underlying stitch sewing data producing unit which produces data of underlying stitch sewing based on the synthesized outline data.

24 Claims, 11 Drawing Sheets

EMBROIDERY DATA PRODUCING DEVICE AND EMBROIDERY DATA PRODUCING PROGRAM STORED IN A COMPUTER READABLE MEDIUM

BACKGROUND OF THE INVENTION

1. Field of the Invention

This invention relates to an embroidery data producing device and an embroidery data producing program, and more particularly to such an embroidery data producing device and an embroidery data producing program capable of producing underlying stitch sewing data so that a pattern corresponding to an image comprising a plurality of areas is sewn or so that an embroidery pattern comprising a plurality of embroidery areas is sewn.

2. Description of the Related Art

It is generally known that a part of work cloth inside an outline is filled with stitches in one type of embroidery sewing manner. When the aforesaid embroidery sewing manner is carried out, rough underlying stitches are sewn under the stitches of embroidery sewing in order that work cloth may be prevented from shrinking during embroidering or that a sewn embroidery pattern may have a three-dimensional effect. For example, Japanese Patent Application Laid-Open No. 2002-119780 discloses an embroidery data processing device which is capable of producing data of underlying stitches on an embroidery pattern including a plurality of embroidery areas.

Underlying stitch sewing data are produced for a plurality of embroidery areas respectively in the foregoing processing device. Accordingly, an embroidery pattern 46 of an angel includes a plurality of embroidery areas Bi where i=1, 2, 3 and so on as shown in FIG. 8. The underlying stitch sewing is carried out for each embroidery area Bi of the embroidery pattern 46 based on the underlying stitch sewing data produced by the embroidery data processing device of the cited reference, as shown in FIG. 21.

However, the underlying stitch sewing is carried out for each one of a plurality of embroidery areas Bi in the foregoing reference. As a result, there arises a drawback that the above-described effects of the underlying stitch sewing cannot be achieved. Particularly, few underlying stitches can be sewn in a narrow embroidery area Bi. As a result, work cloth cannot be reinforced sufficiently in the embroidering. Furthermore, embroidered patterns are not three-dimensional, resulting in a drawback that the quality of sewn products is reduced. Yet furthermore, since underlying stitch sewing data is produced for each one of a plurality of embroidery areas Bi, the underlying stitch sewing data is complicated, whereupon stitches sewn on the basis of the complicated underlying data are also complicated and a sewing time required for the underlying stitch sewing is disadvantageously increased.

SUMMARY OF THE INVENTION

Therefore, an object of the present invention is to provide an embroidery data producing device capable of synthesizing a plurality of areas composing an image or a plurality of embroidery areas composing an embroidery pattern and producing underlying stitch sewing data based on synthesized outline defining an outline of the synthesized area.

The present invention provides an embroidery data producing device reading an image composed of a plurality of areas to produce embroidery data including sewing data for filling each area with stitches and underlying stitch sewing data for carrying out underlying stitch sewing for each of the areas, the device comprising synthesized outline data producing means for producing data of a synthesized outline defining an outline of a synthesized area formed by synthesizing a part or all of a plurality of the areas, and underlying stitch sewing data producing means for producing data of underlying stitch sewing based on the synthesized outline data.

In the foregoing device, synthesized outline data is produced with respect to a synthesized area formed by synthesizing a part or all of a plurality of areas constituting an image. Underlying stitch sewing data is produced on the basis of the synthesized outline data. The underlying stitches are sewn using the produced underlying stitch sewing data. Consequently, an embroidery pattern sewn over the underlying stitches can achieve a three-dimensional effect. Furthermore, since work cloth can be reinforced sufficiently in the embroidery sewing, the sewing quality can be improved. Particularly, the foregoing effects can be achieved even in the case of narrow areas where few underlying stitches can conventionally be sewn. Yet furthermore, since the areas are synthesized together so that the underlying stitch sewing data is produced, the underlying stitch sewing data can be simplified. Consequently, the underlying stitch sewing work carried out using the underlying stitch sewing data can be simplified and a time period required for sewing underlying stitches can be reduced.

The invention also provides an embroidery data producing device reading sewing data of embroidery pattern composed of a plurality of embroidery areas to produce underlying stitch sewing data for the embroidery areas on the basis of the sewing data, the device comprising outline data extracting means for extracting outline data of each embroidery area from the sewing data, synthesized outline data producing means for producing data of a synthesized outline by synthesizing a part or all of a plurality of the outline data corresponding to a plurality of the embroidery areas extracted by the outline data extracting means and underlying stitch sewing data producing means for producing data of underlying stitch sewing based on the synthesized outline data.

In the above-described device, sewing data of an embroidery pattern composed of a plurality of embroidery areas is read and outline data of each embroidery area is extracted from sewing data by the outline data extracting means. A part of or all of a plurality of the outline data are synthesized to be produced as synthesized outline data. Since underlying stitch sewing data is produced on the basis of the synthesized outline data, underlying stitches sewn using the underlying stitch sewing data can give a cubic effect to an embroidery pattern embroidered over the underlying stitches. Furthermore, the sewing quality can be improved since work cloth is reinforced by the underlying stitches when an embroidery patter is sewn. The aforementioned effect can be achieved even in a narrow embroidery area in which few underlying stitches have conventionally been sewn. Still further, since the outlines are synthesized to be produced as underlying stitch sewing data, the underlying stitch sewing data can be simplified. Consequently, the sewing work for the underlying stitches using the underlying stitch sewing data can be simplified and accordingly, a time period required for the sewing work for the underlying stitch sewing can be reduced.

BRIEF DESCRIPTION OF THE DRAWINGS

Other objects, features and advantages of the present invention will become clear upon reviewing the following description of the embodiments with reference to the accompanying drawings, in which:

FIG. 7 shows an image to be read in;

DETAILED DECRIPTION OF THE INVENTION

Figure 1:
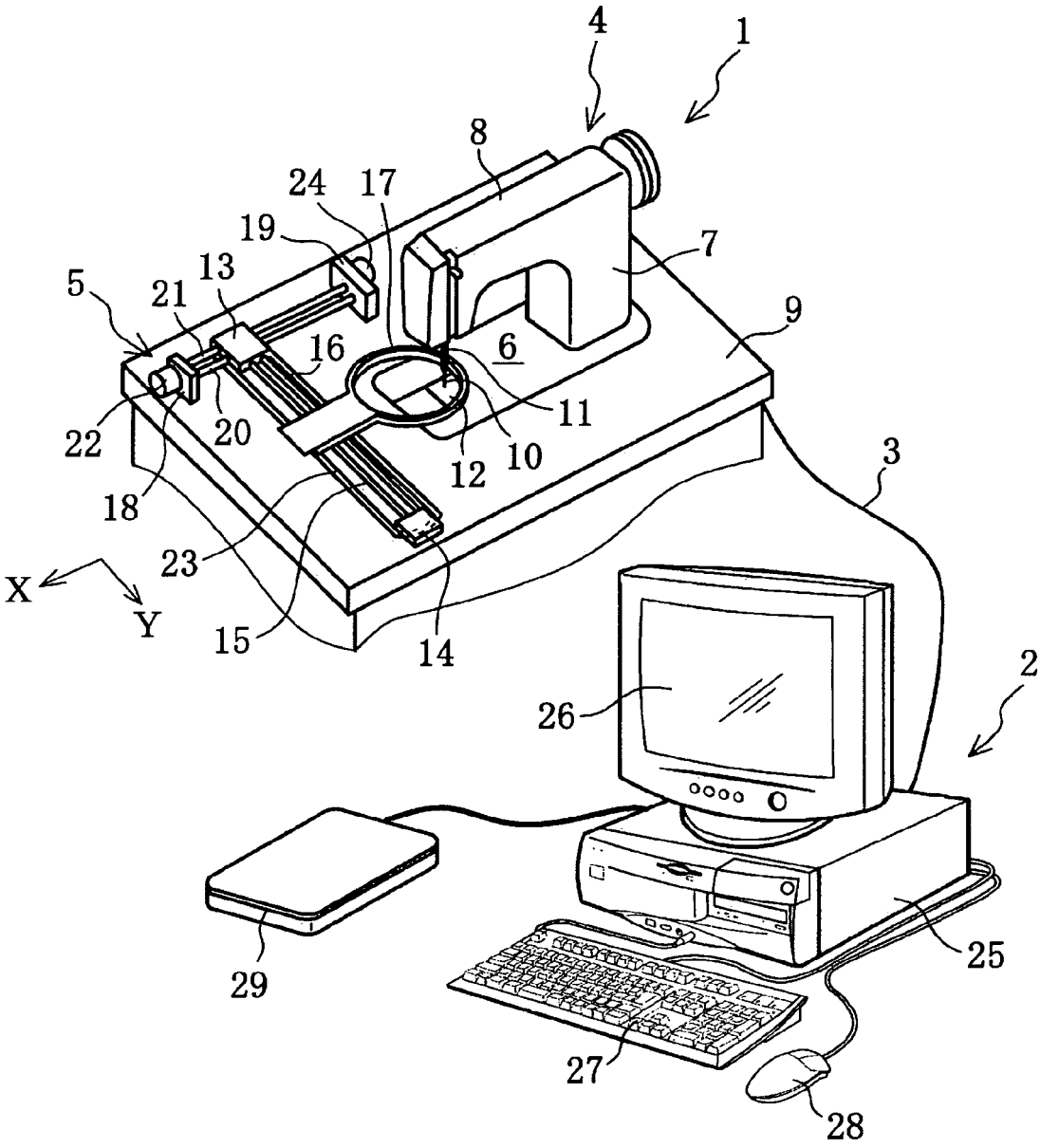
FIG. 1 is a perspective view of an embroidering and sewing machine and an embroidery data producing device in accordance with a first embodiment of the present invention.

An embodiment of the present invention will be described with reference to FIGS. 1 to 13. In the embodiment, the invention is applied to an embroidery data producing device for producing embroidery data provided for sewing an embroidery pattern using an embroidering and sewing machine and including underlying stitch sewing data, and further to an embroidery data producing program on which the embroidery data producing device is operated. An embroidering and sewing machine 1 is shown as being connected via a data transfer cable 3 to an embroidery data producing device 2, as shown in FIG. 1.

Firstly, the embroidering and sewing machine 1 will be described in brief with reference to FIG. 1. The embroidering and sewing machine 1 comprises a sewing machine body 4 and an embroidery frame moving mechanism 5 for moving an embroidery frame 17 right and left or in the X-direction and back and forth or in the Y-direction. The sewing machine body 4 includes a sewing bed 6, a sewing pillar 7 standing from a right end of the bed 6 and a sewing arm 8 extending leftward from an upper end of the pillar 7 so as to be opposed to the bed 6. The body 4 is installed on a sewing machine table 9 with the bed 6 being assembled into the table. The arm 8 has at its left end an arm head provided with a needle bar 11 to which a sewing needle 10 is attached. The needle bar 11 is moved up and down by a needle bar driving mechanism (not shown). A shuttle mechanism (not shown) is provided below a needle plate 12 and driven in synchronization with the up-and-down movement of the needle bar 11.

The embroidery frame moving mechanism 5 will now be described. The sewing table 9 is provided with two moving members 13 and 14 both of which are movable right and left. The moving members 13 and 14 are spaced from each other in the Y-direction. Two guide rods 15 and 16 are provided so as to be spaced away from each other right and left in parallel to each other between the moving members 13 and 14. The embroidery frame holding work cloth has a left end which is coupled to the guide rods 15 and 16 so as to be movable in the Y-direction. A pair of right and left brackets 18 and 19 are secured to the sewing table 9. A lead shaft 20 and a transmission shaft 21 are rotatably supported by the brackets 18 and 19. The moving member 13 is brought into threading engagement with the lead shaft 20 so as to be moved in the X-direction. A wire 23 extends between the moving members 13 and 14. The left end of the embroidery frame 17 is connected to the wire 23.

The lead shaft 20 is rotated by an X-axis drive motor 22. When the moving member 13 is driven in the X-axis direction by the rotation of the lead shaft 20, the moving member 14 and the embroidery frame 17 are also moved together with the moving member 13. On the other hand, when the transmission shaft 21 is rotated by a Y-axis drive motor 24, rotation of the shaft 21 is transmitted via the wire 23 to the embroidery frame 17, thereby driving the latter in the Y-axis direction. In the embroidering and sewing machine 1, on the basis of embroidery data produced by the embroidery data producing device 2, the embroidery frame 17 is moved in the X-axis and Y-axis directions by the X-axis and Y-axis drive motors 22 and 24 so that work cloth is moved in the X-axis and Y-axis directions, whereby embroidery sewing is carried out.

The embroidery data producing device 2 will now be described. The embroidery data producing device 2 produces data of a synthesized outline defining an outline of synthesized area formed by synthesizing a part or all of a plurality of areas composing an image. The embroidery data producing device 2 further produces underlying stitch sewing data based on the synthesized outline data.

Figure 7:
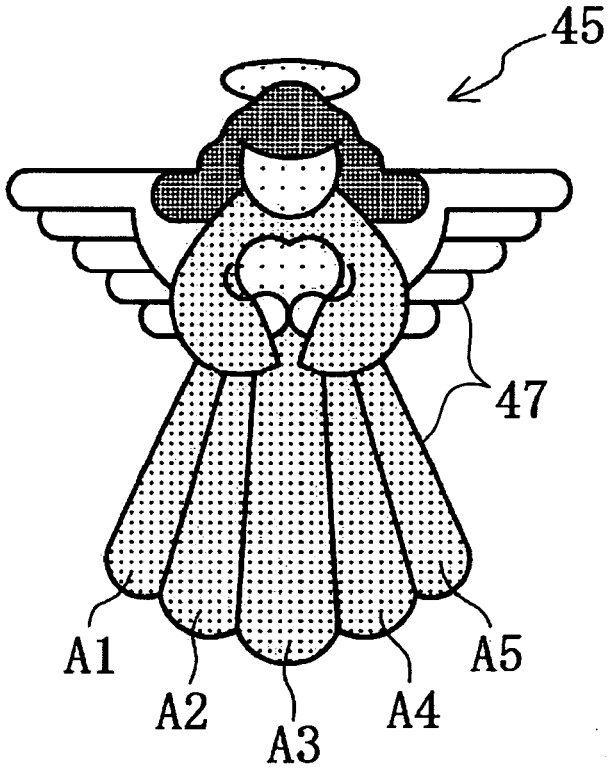
Figure 8:
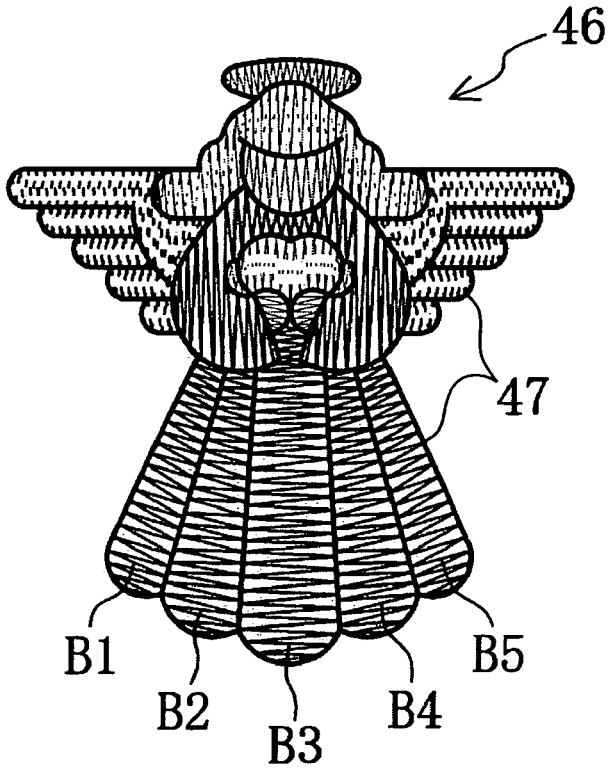
FIG. 8 shows an embroidery pattern embroidered.

The embroidery data producing device 2 comprises a personal computer 25 which will hereinafter be referred to as "PC 25," a display 26, a key board 27, a mouse 28, an image scanner 29, etc. When an embroidery pattern 46 as shown in FIG. 8 is to be sewn, an image 45 corresponding to the embroidery pattern 46 is read in as shown in FIG. 7, so that data of an outline 47, sewing data, underlying stitch sewing data and the like are produced. The outline 47 defines an outline of embroidery area Bi of the embroidery pattern 46.

Figure 2:
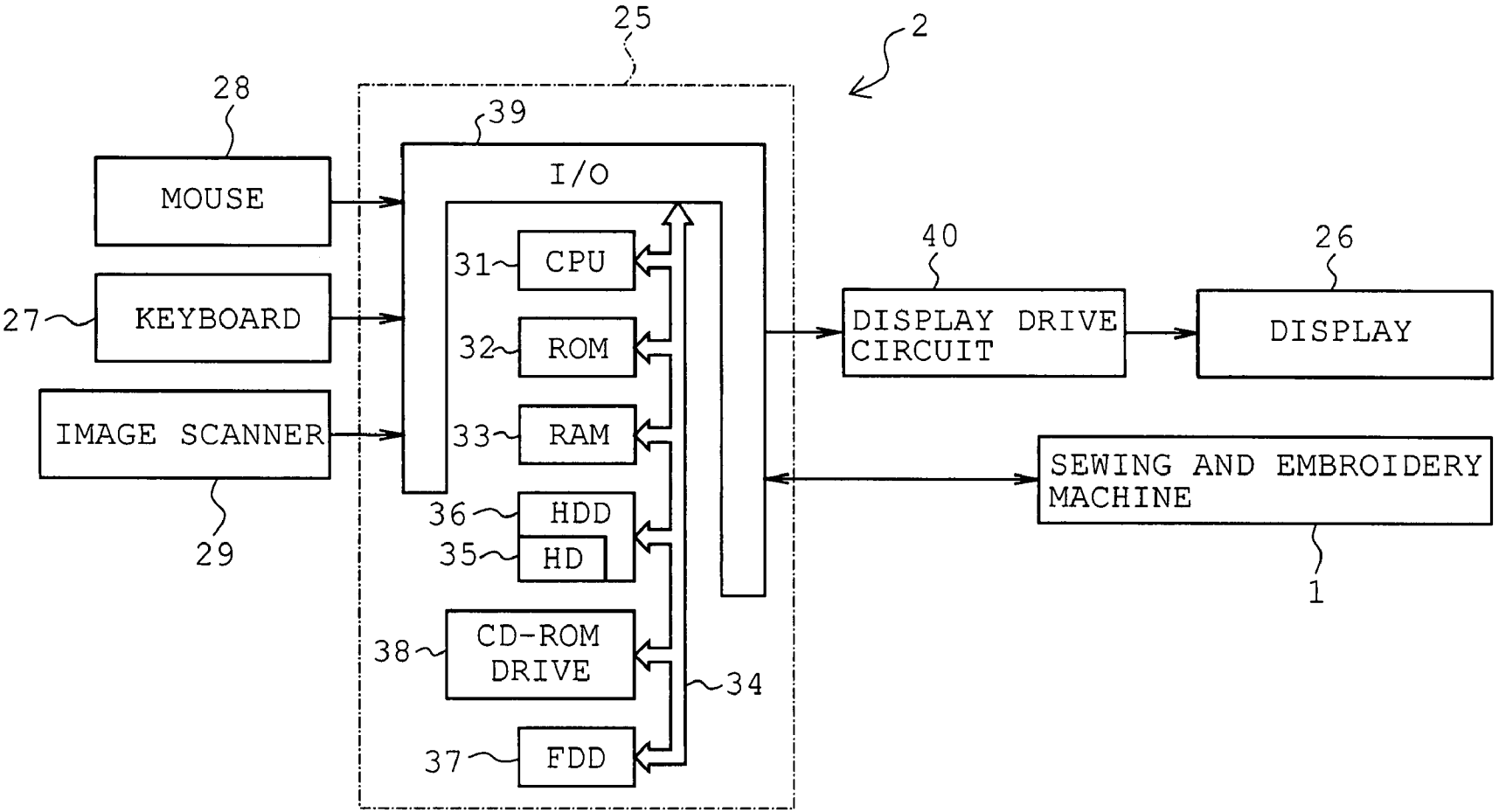
FIG. 2 is a block diagram showing a control system of the embroidery data producing device.

PC 25 manages the whole control about the origination of embroidery data as shown in FIG. 2. PC 25 includes a microcomputer further including CPU 31, ROM 32, RAM 33 and buses 34 connecting the formers. PC 25 further includes a hard disc drive (HDD) 36 provided with a hard disc (HD) 35 connected to the bus 34. PC 25 yet further includes an input/output interface 39 and the like. A flexible disc drive 37 and a CD-ROM drive 38 are also connected to the bus 34. Furthermore, to the input/output interface 39 are connected the embroidering and sewing machine 1, a display drive circuit 40 for connecting the display 26, the keyboard 27, the mouse 28, the image scanner and the like.

ROM 32 stores a start-up program to start up the PC 25 upon power-on thereof etc. HD 35 stores an operating system (OS), drivers for rendering the display 26, keyboard 27, mouse 28, image scanner 29 and the like usable respectively and various programs such as an embroidery data producing program which will be described later. Furthermore, HD 35 also stores input image data read in by the image scanner 29, embroidery data of the embroidery pattern 46 produced on the embroidery data producing program and the like.

The following will describe the embroidery data producing program executed by the embroidery data producing device 2. Symbol Si where i=1, 2, 3 and so on designates a step number. The embroidery data producing program is used to produce embroidery data including sewing data and underlying stitch sewing data. More specifically, for example, the image scanner 29 reads in an image of an angel 45 composed of a plurality of areas Ai (where i=1, 2, 3 and so on) divided by color, as shown in FIG. 7. Based on the aforesaid sewing data, the embroidery area Bi corresponding to the area Ai as shown in FIG. 8 is filled with stitches sewn using an embroidery thread of each of a plurality of colors so as to be buried, whereby the embroidery pattern 46 of the angel is embroidered. The embroidering is carried out on the basis of the aforesaid sewing data. Furthermore, the underlying stitch sewing is carried out for the embroidery pattern 46 on the basis of the aforesaid underlying stitch sewing data. Further, line-like stitches are also formed along an outline of the embroidery pattern 46 of the angel.

Figure 3:
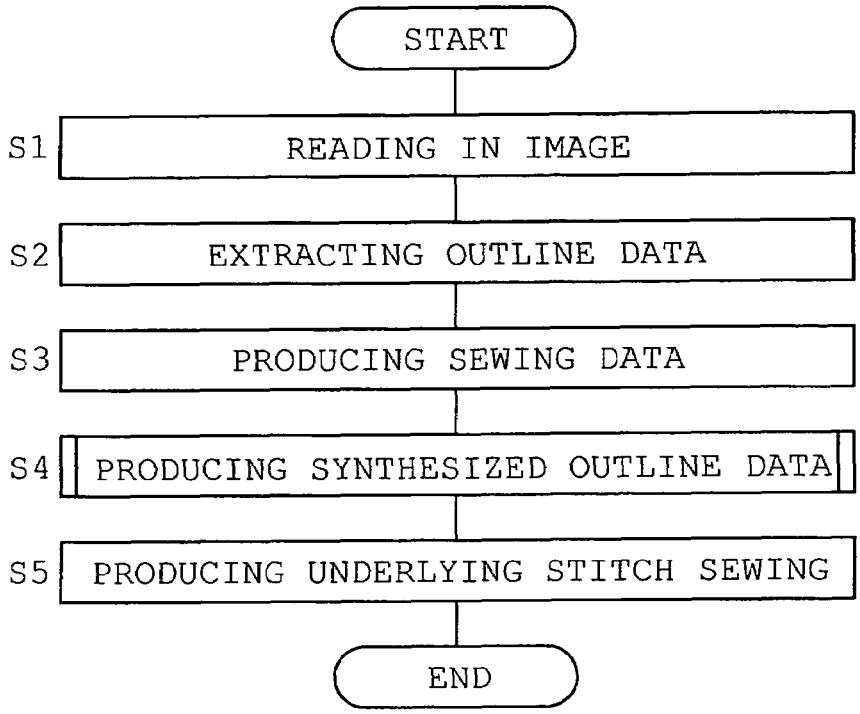
FIG. 3 is a flowchart showing a main routine of an embroidery data producing program.
Figure 11:
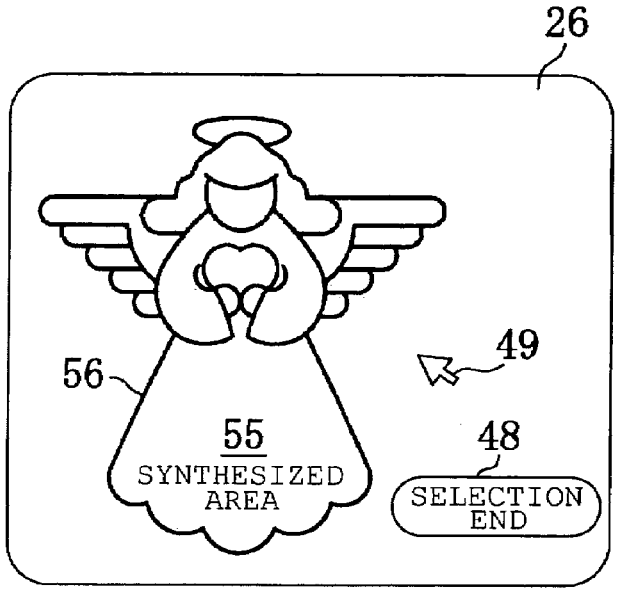
FIG. 11 shows the synthesized outline formed by synthesizing selected areas.
Figure 12:
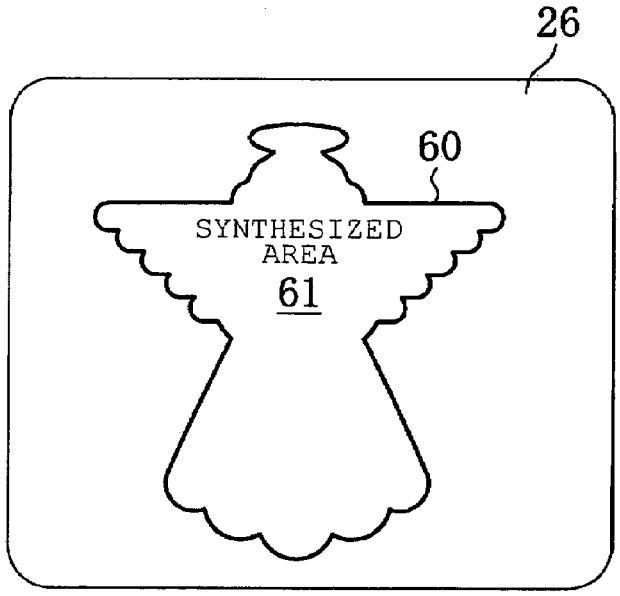
FIG. 12 shows the synthesized outline formed by synthesizing all areas.

A main routine will first be described with reference to FIG. 3. Firstly, the angel image 45 is read in by the image scanner 29 (step S1). The angel image 45 is divided by colors of red, blue, yellow etc. into a plurality of areas Ai including an angel's dress, hair, ring and so on. Data of an outline 47 defining each divided area Ai is extracted from the image data (step S2). Embroidery data for sewing the embroidery pattern 46 as shown in FIG. 8 is produced on the basis of data of the outline 47 and the color of area Ai (step S3). Subsequently, a synthesized outline data producing process is carried out. More specifically, a part or all of a plurality of the areas Ai are synthesized into synthesized areas 55 and 61 as shown in FIGS. 11 and 12. Data of synthesized outlines 56 and 60 defining outlines of the synthesized areas 55 and 61 are produced respectively (step S4). Next, data of underlying stitch sewing which is to be sewn under embroidery stitches is produced on the basis of the produced synthesized outline data (step S5).

Figure 13:
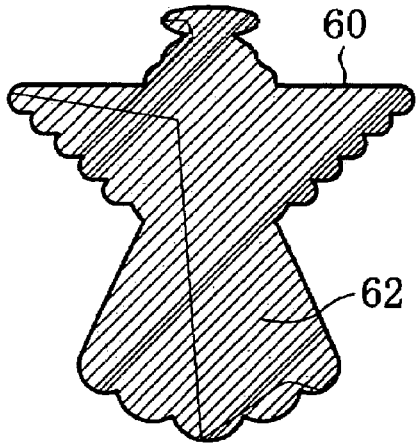
FIG. 13 shows the underlying stitches produced by the synthesized outline of FIG. 12.
Figure 14:
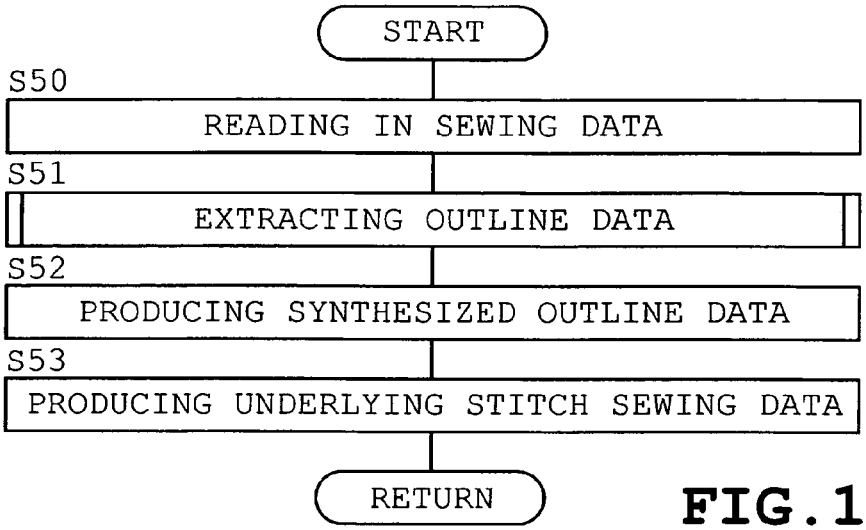
FIG. 14 is a view similar to FIG. 3, showing a second embodiment of the present invention.

Read-in of the image 45 at step S1, extraction of the outline 47 at step S2 and origination of sewing data at step S3 are well known techniques in the art and accordingly, detailed description of these processes will be eliminated. Furthermore, in the process for producing underlying stitch sewing data based on the synthesized outline data at step S5, the same underlying stitch sewing data producing process as the conventional technique can be used with the exception that data of underlying stitch sewing 62 as shown in FIG. 13 is produced on the basis of an offset line obtained by offsetting a synthesized outline, for example, inward about 1 mm. Accordingly, detailed description of step S5 will be eliminated but in short, data is produced which is used for sewing the inside of the produced offset line with a thread density higher than the embroidery sewing (for example, thread density: 2 mm per thread and stitch pitch: 4 mm). The underlying stitch sewing data includes data of colors of embroidery threads used for the underlying stitch sewing. The thread color data is set so as to have the same thread color as the thread color data for the area in which embroidery sewing is initially carried out.

Figure 4:
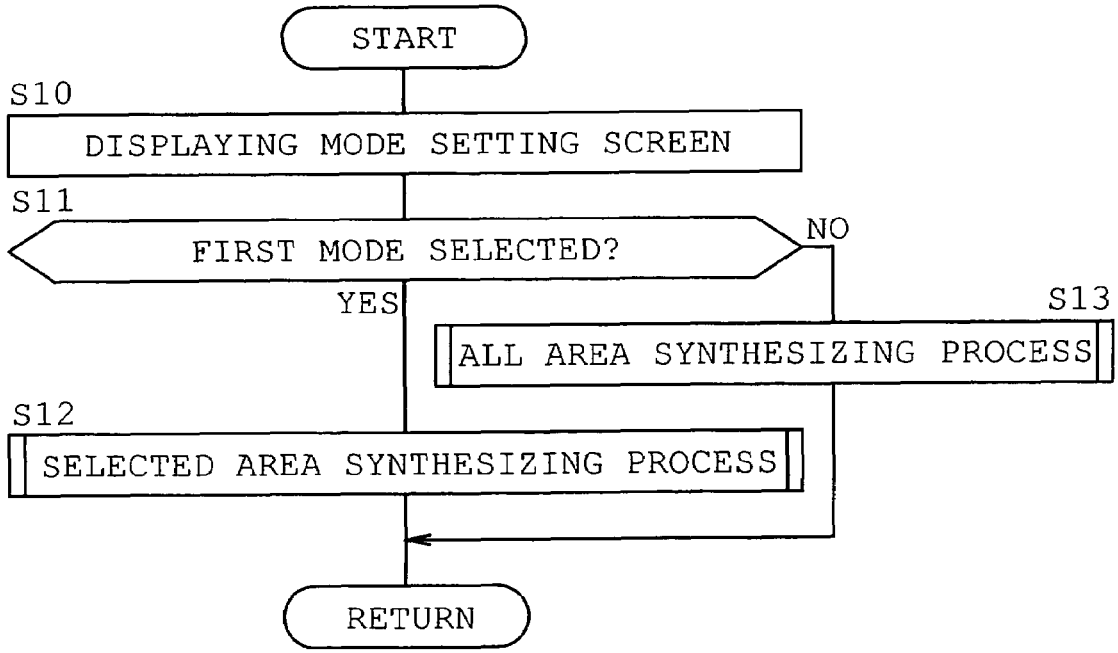
FIG. 4 is a flowchart showing processing for producing synthesized outline data.

The process of producing synthesized outline data at step S4 will be described with reference to FIG. 4. Firstly, a mode setting screen is displayed on the display 26 (step S10). The mode setting screen is cable of setting a first mode or a second mode (step S10). PC 25 advances to step S12 when the user selects the first mode using the mouse 28 or keyboard 27 (Yes at step S11). On the other hand, PC 25 advances to step S13 when the user selects the second mode (No at step S11). The first mode produces data of synthesized outline defining an outline of a synthesized area obtained by synthesizing only a plurality of areas selected by the user to be synthesized. The second mode produces data of synthesized outline data defining an outline of synthesized area obtained by synthesizing all the areas.

Figure 5:
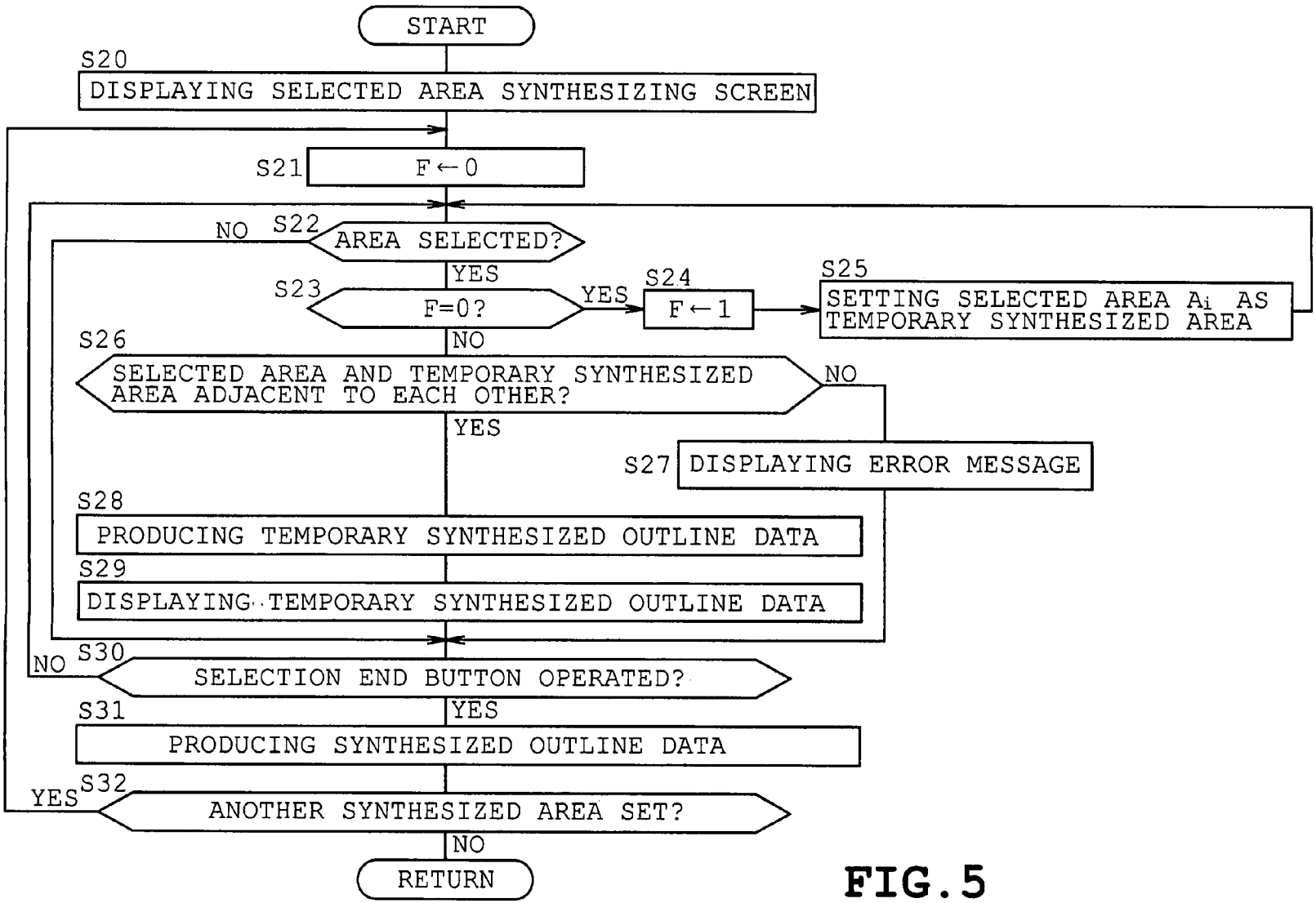
FIG. 5 is a flowchart showing processing for synthesizing selected areas.
Figure 9:
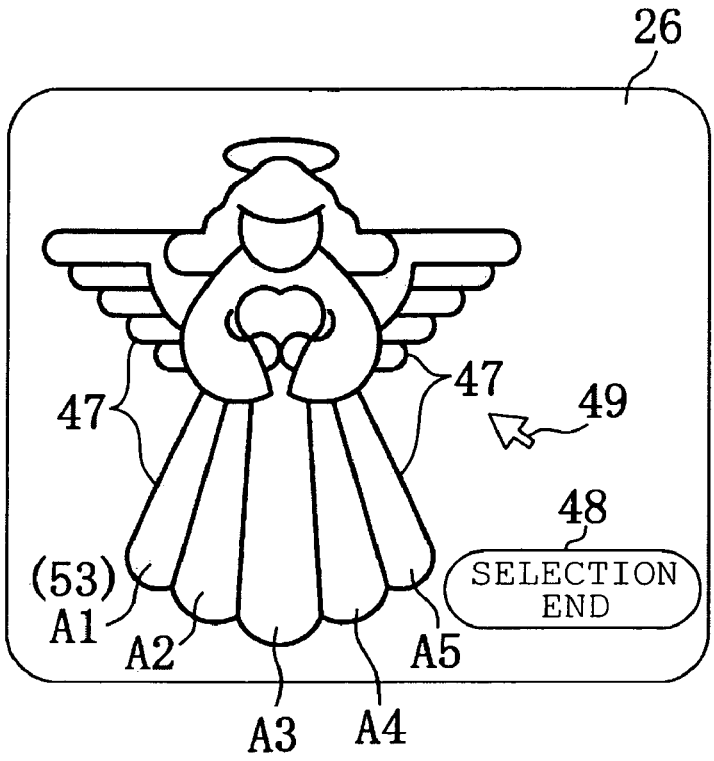
FIG. 9 shows a screen displaying synthesis of selected areas.

A process for synthesizing selected areas will be described with reference to FIG. 5. The selected areas synthesizing process is carried out at step S12 when the first mode has been selected. Firstly, the display 26 displays a selected areas synthesizing screen containing an outline 47 of the read image 45, a select end button 48, cursor 49 and the like, as shown in FIG. 9 (step S20). A determination flag F is provided for determining whether a selected area $A_i$ is an initial selected area. In this case, the flag F is set to "0" (step S21). Next, PC 25 advances to step S30 when the user has not selected the area $A_i$ (No at step S22). On the other hand, PC 25 advances to step S23 when the user has operated via the mouse 28 the cursor 49 to select the area $A_i$ ($A_1$, for example) to be synthesized (Yes at step S22).

When F=0 (Yes at step S23) or this is the first time of selection of area $A_i$, the flag F is set to "1" (step S24) and the initially selected area Ai is set as a temporary synthesized area 53 (step S25). PC 25 then returns to step S22. Subsequently, when F=1 (No at step S23) or the currently selected area $A_i$ is not a first one but an area $A_i$ has already been selected to be set as a temporary synthesized area 53, PC 25 advances to step S26 to determine whether the currently selected area $A_i$ (area $A_3$, for example) is adjacent to the temporary synthesized area 53. When determining that the area $A_i$ is not adjacent to the area 53 (No at step S26), PC 25 displays on the display 26 an error message that the selected area $A_i$ cannot be synthesized (step S27), advancing to step S30.

Figure 10:
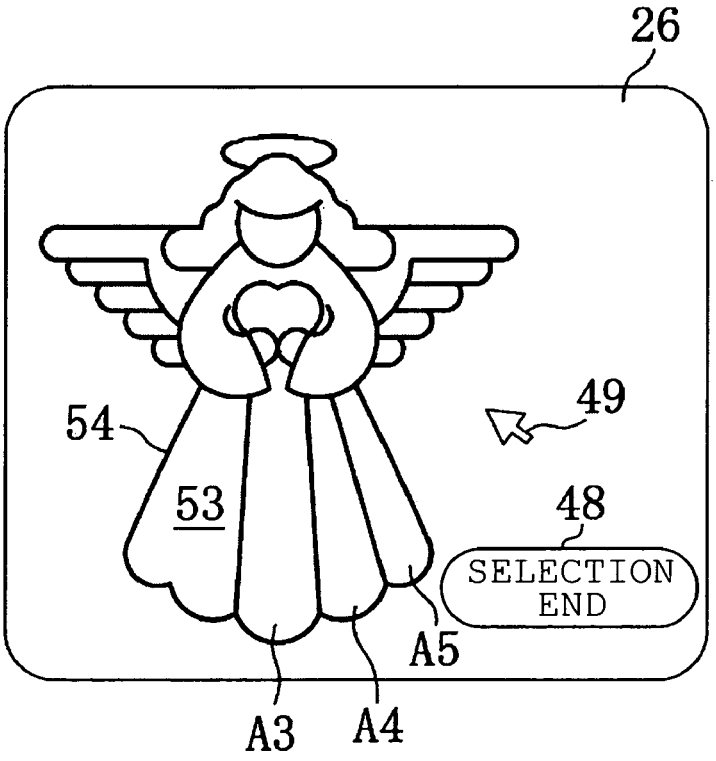
FIG. 10 shows a stage in the production of synthesized outline.

On the other hand, when determining that the area $A_i$ (area $A_2$, for example) is adjacent to the area 53 (Yes at step S26), PC 25 synthesizes the outlines 47 of the respective areas $A_i$ to produce data of a temporary synthesized outline defining an outline of the new temporary synthesized area 53 obtained by synthesizing the selected area $A_i$ and temporary synthesized area 53 (step S28). Successively, a temporary synthesized outline 54 as shown in FIG. 10 is displayed on the display 26 on the basis of the temporary synthesized outline data (step S29).

PC 25 returns to step S22 when the user has not operated the select end button 48 (No at step S30). When steps S21 to S30 have been repeated at a plurality of times so that the user has selected areas $A_1$ to $A_5$ corresponding to the skirt of the angel and then operated the select end button 48 (Yes at step S30), PC 25 determines that selection has ended and produces data of a synthesized outline 56 defining an outline of synthesized area 55 with the temporary synthesized outline data serving as the synthesized outline data (step S31). Furthermore, when the user has selected setting of another synthesized area (Yes at step S32), PC 25 returns to step S21. When the user has selected not setting a new synthesized area (No at step S32), PC 25 returns to the main routine.

Figure 6:
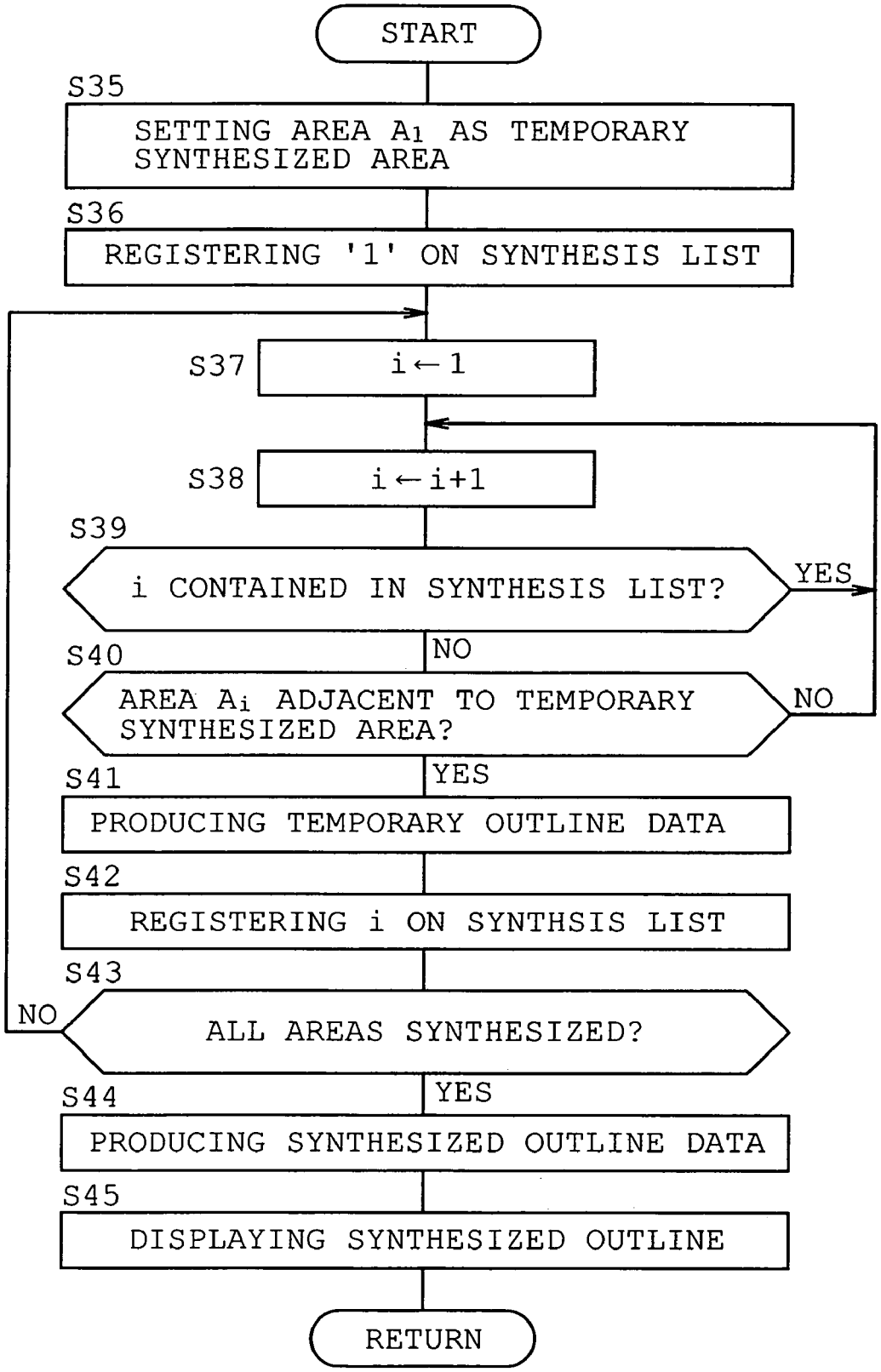
FIG. 6 is a flowchart showing processing for synthesizing all areas.

The all area synthesizing process to be carried out at step S13 upon selection of the second mode will now be described with reference to FIG. 6. Firstly, the area $A_1$ is set as a temporary synthesized area (step S35) and "1" is set to the synthesis list for storing already synthesized area numbers (step S36). "1" is further set to the area number i (step S37). Subsequently, (i+1) is set to i (step S38) and then, PC 25 determines whether i has been set to the synthesis list. When i has been set to the synthesis list (Yes at step S39), PC 25 returns to step S38 since the area $A_i$ has been synthesized. On the other hand, when i has not been contained in the synthesis list (No at step S39), PC 25 then determines whether the area $A_i$ is adjacent to the temporary synthesized area. When determining that the area $A_i$ is not adjacent to the temporary synthesized area (No at step S40), PC 25 returns to step S38 since the area $A_i$ cannot be synthesized with the temporary synthesized area.

On the other hand, when determining that the area $A_i$ is adjacent to the temporary synthesized area (Yes at step S40), PC 25 produces data of temporary synthesized outline defining an outline of a new temporary synthesized area obtained by synthesizing the area Ai and the temporary synthesized area (step S41). An area number i of the synthesized area $A_i$ is registered on the synthesis list (step S42). When still determining that not all the areas $A_i$ have been synthesized, based on the synthesis list (No at step S43), PC 25 returns to step S37. When determining that all the areas $A_i$ have been synthesized on the basis of the synthesis list (Yes at step S43), PC 25 produces data of synthesized outline 60 defining the outline of the synthesized area 61 with the temporary outline data as synthesized outline data (step S44). Successively, a synthesized outline 60 as shown in FIG. 12 is displayed on the display 26 on the basis of the synthesized outline data. PC 25 then returns to the main routine to produce data of underlying stitch sewing 62 as shown in FIG. 13 at step S5.

The operation and advantages of the embroidery data producing device will now be described. In the embodiment, the embroidery data producing device produces the data of the synthesized outlines 56 and 60 defining the outlines of the synthesized areas 55 and 61 obtained by synthesizing a part or all of a plurality of the areas $A_i$ constituting the image 45. The embroidery data producing device then produces the underlying stitch sewing data based on the synthesized outline data. Accordingly, since the embroidery pattern 46 is sewn over the underlying stitches sewn using the underlying stitch sewing data, the three-dimensional effect can be achieved. Furthermore, since the work cloth can sufficiently be reinforced in the embroidery sewing, the sewing quality can be improved. In particular, the foregoing effects can be achieved even in such a narrow area where the underlying stitches cannot almost be sewn conventionally. Yet furthermore, since the underlying stitch sewing data is produced by synthesizing the areas $A_i$, the underlying stitch sewing data can be simplified. Consequently, the underlying stitch sewing operation can be simplified and the sewing time period required for the underlying stitch sewing can be reduced.

Furthermore, the embroidery data producing device can be set either to the first or to the second mode by the user. When the embroidery data producing device is set to the first mode, the synthesized outline 56 of the synthesized area 55 obtained by synthesizing only the areas $A_i$ can be produced. Accordingly, freedom in the underlying stitch sewing can be improved. Furthermore, when the embroidery data producing device is set to the second mode, data origination can be simplified regarding the synthesized outline 60 used in the case where the underlying stitch sewing is carried out for all the areas $A_i$. Yet furthermore, the thread color data for the underlying stitch sewing is the same as the thread color data for the initial area $A_i$ to be embroidered. Accordingly, the embroidery sewing machine can be transferred from the underlying stitch sewing to the embroidery sewing without change in the thread.

FIGS. 14 to 17 illustrate a second embodiment of the invention. In the second embodiment, the invention is applied to an embroidery data producing device reading in sewing data of an embroidery pattern composed of a plurality of embroidery areas and producing data of underlying stitch sewing for the embroidery areas on the basis of the read sewing data, and an embroidery data producing program. The control system of the embroidery data producing device in the second embodiment is similar to that of the first embodiment and accordingly, the description of the control system will be eliminated.

An embroidery data producing program carried out by the personal computer of the embroidery data producing device 2 will be described with reference to FIGS. 14 to 17. A main routine will first be described. The personal computer firstly reads sewing data stored on FD or CD-ROM or for example, reads via FDD 37, CD-ROM drive 38 or the like sewing data of the embroidery pattern 46 of the angel composed of a plurality of embroidery areas Bi as shown in FIG. 8 (step S50). Subsequently, data of an outline 47 of each embroidery area Bi is extracted from the read sewing data (step S51). Synthesized outline data 56 and 60 are produced by synthesizing a part or all of a plurality of outline data corresponding to a plurality of the embroidery areas $B_i$ extracted at step S51 respectively (step S52). Data of underlying stitch sewing is produced on the basis of the synthesized outline data (step S53).

Read-in of sewing data at step S50 is a well known technique and origination of underlying stitch sewing data at step S53 is similar to that in the first embodiment. Accordingly, the description of techniques will be eliminated. Furthermore, regarding origination of synthesized outline data at step S52, the same processing is executed in the second embodiment as that in the first embodiment with exception of the change from the area $A_i$ to the embroidery area $B_i$. Accordingly, the description of origination of synthesized outline data will be eliminated.

Figure 15:
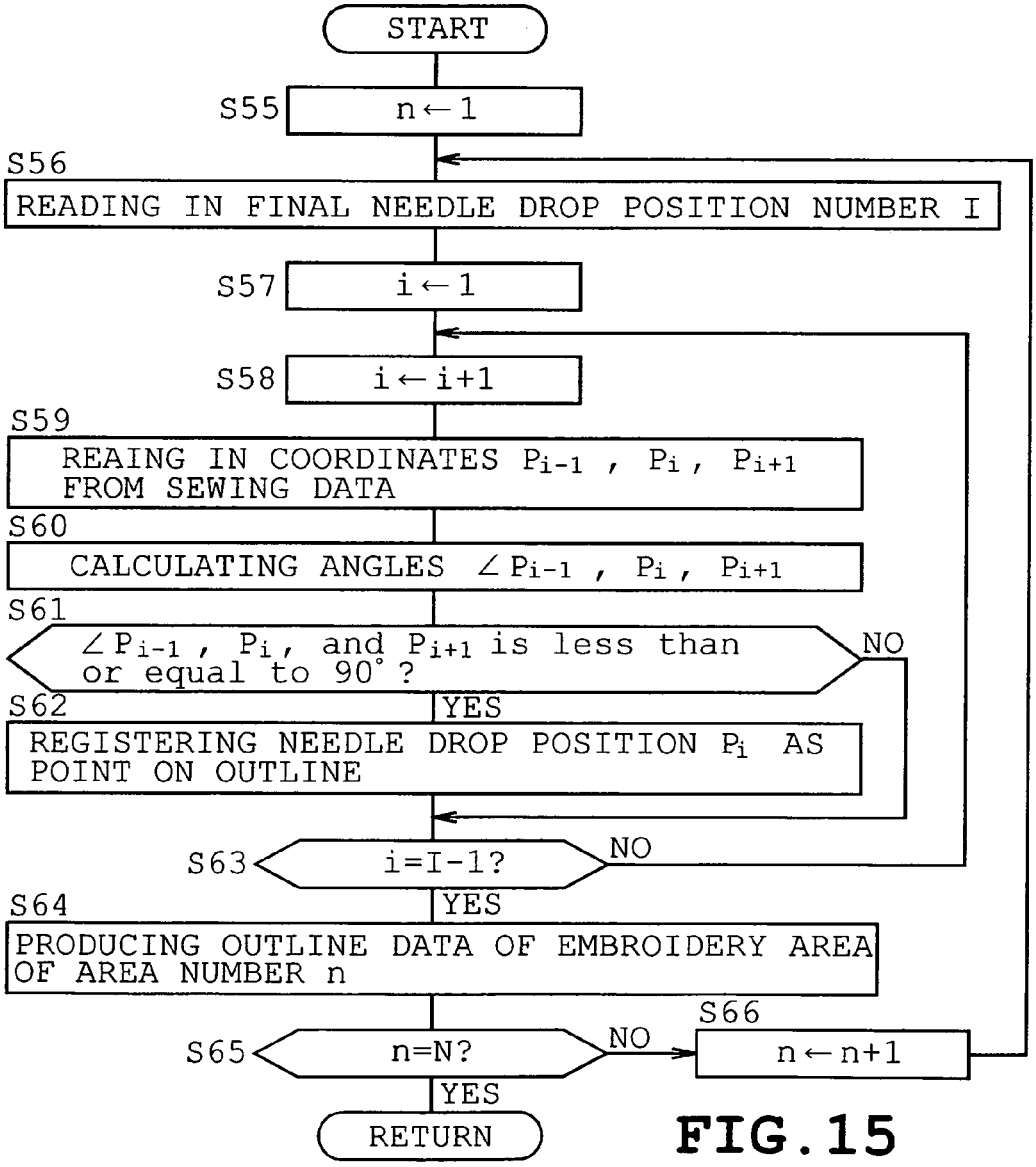
FIG. 15 is a flowchart showing processing for extracting outlines.

An outline data extracting process will be described with reference to FIG. 15. In the process, data of outline 47 is extracted on the basis of data of needle drop position $P_i$ contained in the sewing data. The number of embroidery areas is designated by N. Firstly, "1" is substituted for the embroidery area number n (step S55) and a final needle drop position number I of the embroidery area number n is read in (step S56). "1" is then substituted for i (step S57). Subsequently, i is incremented by 1 (step S58) and data of coordinates of needle drop positions $P_{i-1}$, Pi and $P_{i+1}$ corresponding to needle drop position numbers $P_{i-1}$, i and i+1 respectively are read in (step S59). Angle $\angle P_{i-1}$, $P_i$ and $P_{i+1}$ is then calculated (step S60). Whether angle $\angle P_{i-1}$, $P_i$ and $P_{i+1}$ is less than or equal to 90° (step S61).

Figure 16:
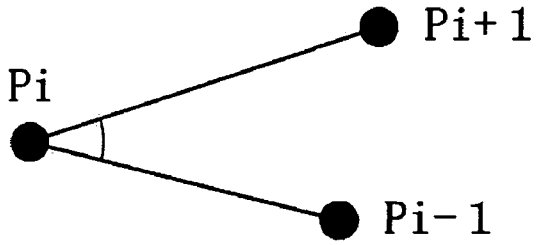
FIG. 16 shows needle drop positions determined to be on the outline.
Figure 17:
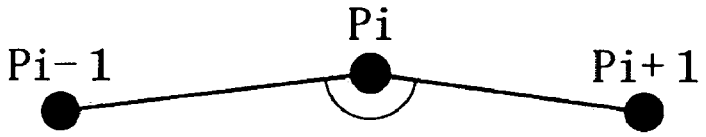
FIG. 17 shows needle drop positions determined not to be on the outline.

For example, when angle $\angle P_{i-1}$, $P_i$ and $P_{i+1}$ is less than or equal to 90° (Yes at step S61), PC 25 determines that the needle drop position $P_i$ is a stitch point which is a turning pint of stitches, as shown in FIG. 16. In this case, the needle drop position $P_i$ is registered as a point on the outline 47 (step S62). On the other hand, when angle $\angle_{Pi-1}$, $P_i$ and $P_{i+1}$ is greater than 90° (No at step S61), PC 25 determines that the needle drop position $P_i$ is a needle drop position between the outlines 47 such as in the case of "tatami" stitches (fill stitches). In this case, PC25 skips step S62 and accordingly does not register needle drop position $P_i$, advancing to step S63. When i=I−1 (Yes at step S63), PC 25 assumes that it has been determined whether all the needle drop positions of embroidery area $B_n$ of area number n are the points on the outline, advancing to step S64 where outline data of the embroidery area $B_n$ is produced (step S64) On the other hand, when i≠I−1 (No at step S63), PC 25 returns to step S58 where calculation is carried out for the subsequent needle drop position. When determining that n=N (Yes at step S65), PC 25 determines that outline data has been produced for all the embroidery areas, returning to the main routine. When determining that n≠N (No at step S65), PC 25 increments n to n+1 (step S66), returning to step S56 where outline data of the subsequent embroidery area $B_n$ is produced. In the second embodiment, outline data is extracted on the basis of the needle drop position $P_i$ of the sewing data. Consequently, the work for extracting the outline data can be simplified. Description is eliminated regarding the same advantages as achieved from the first embodiment.

Figure 18:
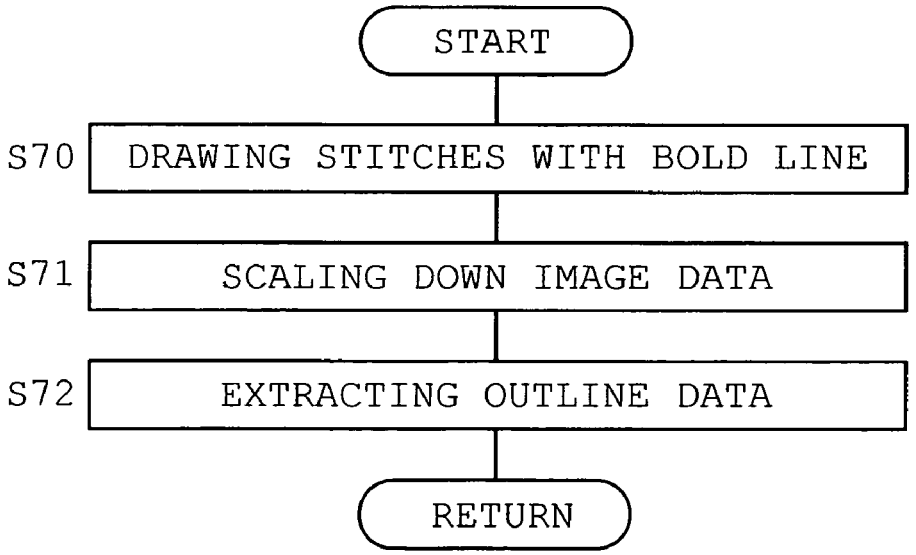
FIG. 18 is a flowchart showing a modified form of processing for extracting outlines.
Figure 19:
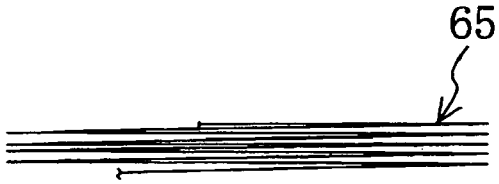
FIG. 19 shows stitches sewn on the basis of sewing data.
Figure 20:
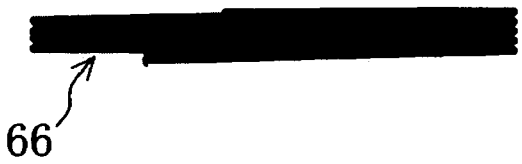
FIG. 20 shows bold image of stitches.
Figure 21:
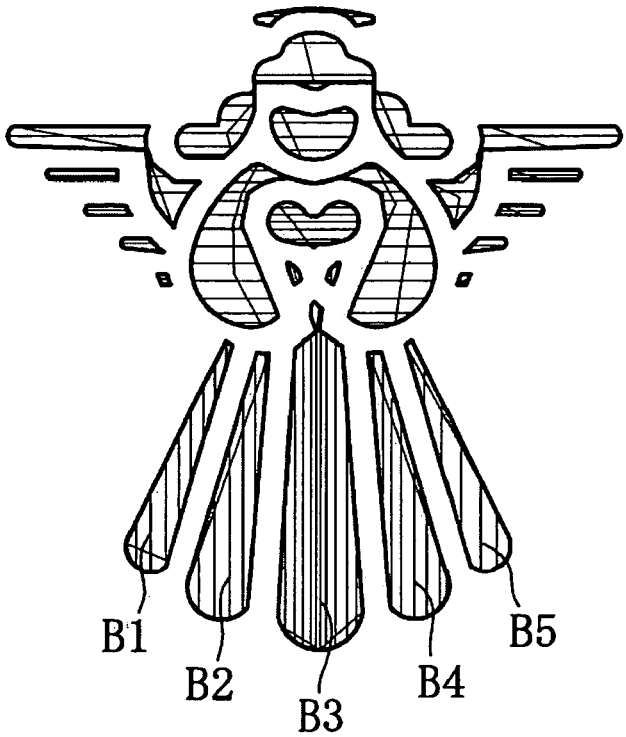
FIG.21 PRIOR ART
FIG. 21 shows underlying stitch sewing in the prior art.

A modified form of the second embodiment will now be described with reference to FIGS. 18 to 20. Only the outline data extracting process carried out at step S51 is modified in the modified form. Accordingly, the outline data extracting process will be described. For example, firstly, FIG. 19 illustrates stitches 65 sewn on the basis of the read sewing data. Each stitch 65 is converted to a bold line or virtual stitch 66 to be drawn as shown in FIG. 20. As a result, gaps between the stitches 65 are buried so that an image of each stitch area $B_i$ is produced (step S70). Subsequently, a folded point of each stitch 65 extends out of the normal embroidery area $B_i$ since the stitches 65 are thickened. Accordingly, the image corresponding to each embroidery area $B_i$ is scaled down about one half of the thickness of the each virtual stitch 66 (step S71). Subsequently, PC 25 then extracts outline data based on the outline of the imaged embroidery area $B_i$ (step S72), returning to the main routine. In the above-described modified form, the outline data extracting process can be simplified since the outline data is extracted on the basis of the outline of the embroidery area $B_i$ imaged from the virtual stitches 66 obtained by converting the stitches 65 to bold lines.

Furthermore, when outline data is contained in sewing data read from FD or the like, only the outline data may be extracted from the sewing data in the outline data extracting process at step S51.

Modified forms common to the foregoing first and second embodiments will be described. The thread color data contained in the underlying stitch sewing data may be set to one of a plurality of the thread color data contained in the sewing data, which one thread color data has a highest brightness of the thread color data. The color with high brightness includes white, light gray, light yellow and other light colors. Consequently, the sewing quality of the embroidery pattern formed over the underlying stitches can be improved without the underlying stitches being conspicuous. Furthermore, the user may set the thread color data of the underlying stitch sewing. Consequently, the freedom in the thread color of the underlying stitch sewing can be improved.

Yet furthermore, the first mode should not be limited to the case where only the areas selected by the user are synthesized. One or more of the areas may automatically be synthesized. For example, only one or more of the areas on which the embroidery sewing is carried out using the same color thread may automatically be synthesized.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An embroidery data producing device reading an image composed of a plurality of areas to produce embroidery data including sewing data for filling each area with stitches and underlying stitch sewing data for carrying out underlying stitch sewing for each of the areas, the device comprising:

synthesized outline data producing means for producing data of a synthesized outline defining an outline of a synthesized area formed by synthesizing a part or all of a plurality of the areas; and underlying stitch sewing data producing means for producing data of underlying stitch sewing based on the synthesized outline data.

2. The embroidery data producing device according to claim 1, further comprising area selecting means for selecting one or more of the areas to be synthesized.

3. The embroidery data producing device according to claim 2, further comprising mode setting means capable of setting either a first mode in which only the areas selected by the area selecting means are synthesized or a second mode in which all the areas are synthesized.

4. The embroidery data producing device according to claim 1, wherein the underlying stitch sewing data includes thread color data for underlying stitch sewing, and the thread color data is set so as to have the same thread color as the thread color data for the area in which embroidery sewing is initially carried out.

5. The embroidery data producing device according to claim 1, wherein the sewing data composed of a plurality of thread color data, and the underlying stitch sewing data includes thread color data for underlying stitch sewing, and the thread color data for the underlying stitch sewing is set to one of a plurality of the thread color data included in the sewing data, said one thread color data having a highest brightness of a plurality of the thread color data.

6. An embroidery data producing device reading sewing data of embroidery pattern composed of a plurality of embroidery areas to produce underlying stitch sewing data for the embroidery areas on the basis of the sewing data, the device comprising:

outline data extracting means for extracting outline data of each embroidery area from the sewing data;

synthesized outline data producing means for producing data of a synthesized outline by synthesizing a part or all of a plurality of the outline data corresponding to a plurality of the embroidery areas extracted by the outline data extracting means; and underlying stitch sewing data producing means for producing data of underlying stitch sewing based on the synthesized outline data.

7. The embroidery data producing device according to claim 6, wherein the sewing data includes stitch data representing needle drop position and the outline data extracting means extracts the outline data based on the stitch data included in the sewing data.

8. The embroidery data producing device according to claim 6, wherein the outline data extracting means coverts stitches based on the sewing data into bold line to image each embroidery area and to extract the outline data based on an outline of each embroidery area.

9. The embroidery data producing device according to claim 6, further comprising area selecting means for selecting a plurality of embroidery areas to be synthesized, out of the embroidery areas.

10. The embroidery data producing device according to claim 9, further comprising mode setting means capable of setting either a first mode in which only the areas selected by the area selecting means are synthesized or a second mode in which all the areas are synthesized.

11. The embroidery data producing device according to claim 6, wherein the underlying stitch sewing data includes thread color data for underlying stitch sewing, and the thread color data is set so as to have the same thread color as the thread color data for the area in which embroidery sewing is initially carried out.

12. The embroidery data producing device according to claim 6, wherein the sewing data includes a plurality of thread color data, and the underlying stitch sewing data includes thread color data for underlying stitch sewing, and the thread color data for the underlying stitch sewing is set to one of a plurality of the thread color data included in the sewing data, said one thread color data having a highest brightness of a plurality of the thread color data.

13. An embroidery data producing program stored in a computer readable medium on which an embroidery data producing device reads an image composed of a plurality of areas to produce embroidery data including sewing data for filling each area with stitches and underlying stitch sewing data for carrying out underlying stitch sewing on each area, the embroidery data producing device including a computer executing the program, the program comprising:

a first routine for producing synthesized outline data defining an outline of a synthesized area formed by synthesizing a part or all of a plurality of the areas; and a second routine for producing underlying stitch sewing data based on the synthesized outline data.

14. The embroidery data producing program according to claim 13, wherein only the areas selected from a plurality of areas are synthesized in the first routine.

15. The embroidery data producing program according to claim 14, wherein the first routine is capable of being set either to a first mode in which only the selected areas are synthesized or to a second mode in which all the areas are synthesized.

16. The embroidery data producing program according to claim 13, wherein in the second routine, the underlying stitch sewing data includes thread color data for underlying stitch sewing, and the thread color data is set so as to have the same thread color as the thread color data for the area in which embroidery sewing is initially carried out.

17. The embroidery data producing program according to claim 13, wherein the sewing data includes a plurality of thread color data, and the underlying stitch sewing data includes thread color data for underlying stitch sewing, and the thread color data for the underlying stitch sewing is set to one of a plurality of the thread color data included in the sewing data in the second routine, said one thread color data having a highest brightness of a plurality of the thread color data.

18. An embroidery data producing program stored in a computer readable medium on which a computer of an embroidery data producing device reads sewing data of an embroidery pattern composed of a plurality of embroidery areas and produces embroidery data including underlying stitch sewing data for the embroidery areas based on the sewing data, the embroidery data producing device including a computer executing the program, the program comprising:

a first routine for extracting outline data of each embroidery area from the sewing data;

a second routine for producing synthesized outline data by synthesizing a part or all of a plurality of the outline data corresponding to a plurality of the embroidery areas extracted in the first routine; and a third routine for producing underlying stitch sewing data based on the synthesized outline data.

19. The embroidery data producing program according to claim 18, wherein the sewing data includes stitch data representing needle drop position and the outline data is extracted based on the stitch data included in the sewing data in the first routine.

20. The embroidery data producing program according to claim 18, wherein stitches based on the sewing data is converted into a bold line in the first routine, thereby producing each embroidery area, and the outline data is extracted based on an outline of each embroidery area.

21. The embroidery data producing program according to claim 18, wherein only the embroidery areas selected from a plurality of embroidery areas are synthesized in the second routine.

22. The embroidery data producing program according to claim 21, wherein the second routine is capable of being set either to a first mode in which only the selected areas are synthesized or to a second mode in which all the areas are synthesized.

23. The embroidery data producing program according to claim 18, wherein in the third routine, the underlying stitch sewing data includes thread color data for underlying stitch sewing, and the thread color data is set so as to have the same thread color as the thread color data for the area in which embroidery sewing is initially carried out.

24. The embroidery data producing program according to claim 18, wherein the sewing data includes a plurality of thread color data, and the underlying stitch sewing data includes thread color data for underlying stitch sewing, and the thread color data for the underlying stitch sewing is set to one of a plurality of the thread color data included in the sewing data in the second routine, said one thread color data having a highest brightness of a plurality of the thread color data.

* * * * *